US010273030B2

(12) United States Patent
Lehnen et al.

(10) Patent No.: US 10,273,030 B2
(45) Date of Patent: Apr. 30, 2019

(54) COMPACT FEEDER AND FILLING SYSTEM, DEVICE, AND METHOD

(71) Applicant: Lehnen Industrial Services, Inc., Keene, NH (US)

(72) Inventors: Peter E. Lehnen, Spofford, NH (US); Christopher P. Lehnen, Keene, NH (US); Roger A. Racette, Hillsborough, NH (US)

(73) Assignee: Lehnen Industrial Services, Inc., Keene, NH (US)

( * ) Notice: Subject to any disclaimer, the term of this patent is extended or adjusted under 35 U.S.C. 154(b) by 524 days.

(21) Appl. No.: 14/930,970

(22) Filed: Nov. 3, 2015

(65) Prior Publication Data

US 2016/0122056 A1 May 5, 2016

Related U.S. Application Data

(60) Provisional application No. 62/074,245, filed on Nov. 3, 2014.

(51) Int. Cl.

| | |
|---|---|
| ***B65D 65/42*** | (2006.01) |
| ***B65B 61/26*** | (2006.01) |
| ***B65B 65/00*** | (2006.01) |
| ***B65B 3/16*** | (2006.01) |
| ***B65B 7/28*** | (2006.01) |

(52) U.S. Cl.

CPC ..... *B65B 61/26* (2013.01); *B65B 3/16* (2013.01); *B65B 7/2807* (2013.01); *B65B 65/003* (2013.01)

(58) Field of Classification Search

CPC ..... B65D 77/04
USPC ..... 53/411, 173
See application file for complete search history.

(56) References Cited

U.S. PATENT DOCUMENTS

| | | | |
|---|---|---|---|
| 5,209,044 | A | 5/1993 | D'Addario et al. |
| 6,082,077 | A | 7/2000 | Christ |
| 6,679,303 | B2 | 1/2004 | Christ |
| 6,733,224 | B1 | 5/2004 | Linner |
| 6,739,111 | B2 | 5/2004 | Banks et al. |

*Primary Examiner* — Lori Baker
(74) *Attorney, Agent, or Firm* — Maine Cernota & Rardin

(57) ABSTRACT

In a compact system containers are circulated in fixtures. Containers are fed from a bulk hopper by a conveyor into a primary orienting mechanism and then into the loading mechanism which also serves as the final orienting mechanism. Once a fixture is filled with containers, it is indexed into the filling position. The process conveyor ultimately moves the fixtures to the opposite end of the conveyor where a transfer mechanism indexes the fixture through a cap applicator and cap sealer. Caps are fed from a bulk hopper by a conveyor into a primary orienting mechanism and then through a final orienting/escapement mechanism into an applicator chute. Once the caps are applied, the fixture is indexed into a transfer position for downstream processing. Once emptied of containers, the fixtures are indexed onto a return conveyor where they are transported back to the loading and filling end.

20 Claims, 22 Drawing Sheets

SYSTEM COMPONENT PERSPECTIVE VIEW

SYSTEM COMPONENT PERSPECTIVE VIEW

200

| STAGE ▶ INPUT ▼ | A HOPPERS | B CONVEY | C ORIENT | D TRANSP'RT 1 | E FILLING | F TRANSPORT 2 | G CAPPING | H LABELING | I PRINTING | J EJECT |
|---|---|---|---|---|---|---|---|---|---|---|
| 1. TUBES | TUBE HOPPER | TUBE FEEDER | TUBE ALIGNM'NT | TUBE FIXTURE LOADING | | TUBE PROCESS CONVEYOR | CAP TUBES | | | |
| 2. CAPS | CAP HOPPER | CAP FEEDER | CAP ALIGNM'NT | ? | | CAP CHUTE | CAP TUBES | | | |
| 3. CONTENTS | | | | | FILL TUBES | | | | | |
| 4. LABELS | | | | | | | | LABEL TUBES | | |
| 6. INK | | | | | | | | | PRINT TUBES | |
| | | | | | | | | | | PRODUCT EJECTING |

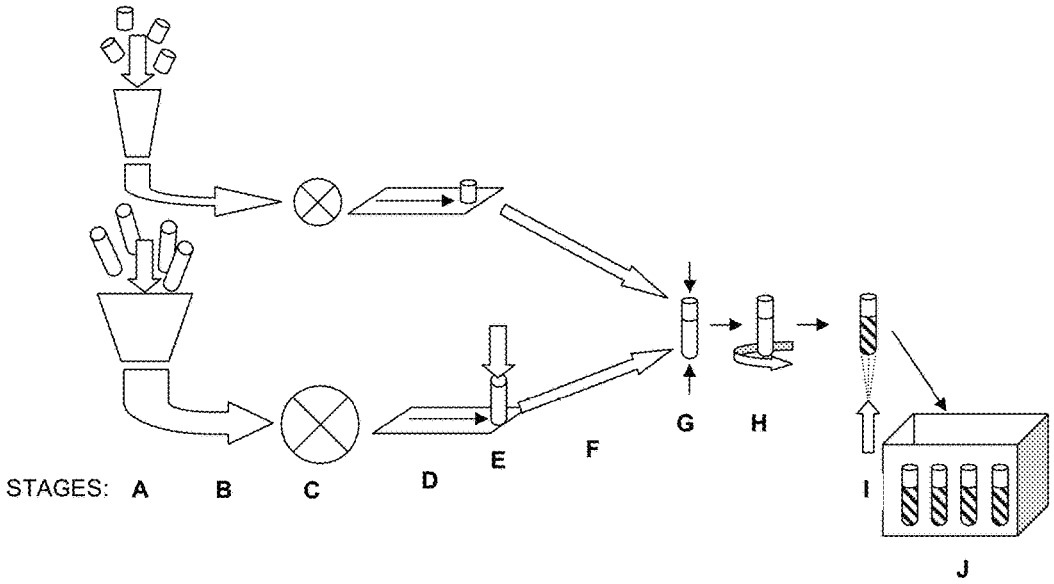

SYSTEM OPERATION DIAGRAM

FIG. 2

CAP BULK HOPPER SECTION

600

PERSPECTIVE VIEW

700

INPUT ELEMENTS

800

TUBE HOPPER INPUT OF SYSTEM STAGE A

900

CAP HOPPER INPUT OF SYSTEM STAGE A

1000

CONTAINER (TUBE) CONVEYING MEANS OF SYSTEM STAGE B

1100

CAP CONVEYING MEANS OF SYSTEM STAGE B

CONTAINER (TUBE) ORIENTING MECHANISMS OF SYSTEM STAGE C

CAP ORIENTING MECHANISMS OF SYSTEM STAGE C

1400

TUBE FIXTURE LOADING TRANSPORT PATH ONE OF SYSTEM STAGE D

1500

CAP APPLICATOR CHUTE TRANSPORT PATH ONE OF SYSTEM STAGE D

1600

TUBE FILLING MECHANISM STATION OF SYSTEM STAGE E

1700

TUBE PROCESS CONVEYOR TRANSPORT PATH TWO OF SYSTEM STAGE F

1800

CAP APPLICATOR AND SEALER CAPPING STATION OF SYSTEM STAGE G

1900

LABELING STATION OF SYSTEM STAGE H

2000

PRINTING STATION OF SYSTEM STAGE I

2100

PRODUCT POST-PROCESSING AND EJECTING OF SYSTEM STAGE J

2200

FLOW CHART OF A METHOD FOR COMPACT FEEDING AND FILLING

COMPACT FEEDER AND FILLING SYSTEM, DEVICE, AND METHOD

RELATED APPLICATION

This application claims the benefit of U.S. Provisional Application No. 62/074,245 filed 3 Nov. 2014. This application is herein incorporated in its entirety by reference.

FIELD OF THE INVENTION

The invention is a machine for fully-automatically or semi-automatically filling containers, in less floor space than can be achieved by current means.

BACKGROUND OF THE INVENTION

Current commercial production filling systems involve large capital investments and require large, permanent, factory installations. Their expansive linear flow incorporates vibratory feeders and other components causing wear, and shortening component life or at least requiring repeated attention. Operating such large-scale equipment can also involve high utility costs. The currently available technologies involve equipment that is normally comprised of several components coupled together, with each component typically being individually supported. High throughput machines are vulnerable to errors and can be shut down and even damaged by issues such as imperfect components and misalignment.

What is needed is an efficient system for filling containers/tubes that occupies less space, reliably feeds tubes and caps from input to output, and does not involve disrupting motion such as vibration.

SUMMARY OF THE INVENTION

An embodiment provides a device for feeding and filling containers comprising a primary container orienting mechanism; a final container orienting and loading mechanism; a plurality of container fixtures; a closure primary orienting mechanism; a closure final orienting escapement mechanism; and wherein once emptied of the containers, the container fixtures are indexed onto a return conveyor where they are transported back to a loading and filling end. In embodiments, container feeder components comprise one or more conveyors for transporting the containers; one or more rotating circular receptacles into which the containers are deposited, from which the containers are output axially oriented; and one or more chutes feeding the containers downward to a final orienting and escapement device depositing the containers into the fixtures with bodies of the containers similarly aligned. In other embodiments, closure feeder components comprise a rotating disc with at least one aperture having a variable rotation rate and direction; the at least one aperture comprising a beveled profile configuration, and a diameter proportionally larger than a diameter of the closure; the aperture being located within the disc at a radius determined to provide optimal feed rates at an angle also determined to provide optimal feed rates. In subsequent embodiments the container is a tube. For additional embodiments the closure is a cap. In another embodiment, the height of the container is greater than the base of the container. For a following embodiment, one or more conveyors for transporting the containers comprises a pair of vertical conveyors, and one or more chutes feeding the containers downward comprises a pair of chutes. In subsequent embodiments the one or more rotating circular receptacles comprises a pair of rotating circular receptacles. In additional embodiments, the container final orienting and loading mechanism places the containers into the fixtures sequentially. In ensuing embodiments the container final orienting and loading mechanism places the containers into the fixtures in parallel. Included embodiments comprise sorting and aligning without vibration. In yet further embodiments the feeders are integral with the system and located within the footprint of the system. Related embodiments comprise at least one processing step comprising heating and or cooling. Further embodiments comprise a container bulk hopper; a container conveying means; a container filling mechanism; a bulk product container; a container process conveyor; a closure bulk hopper; a closure conveying means; a labeling device; a movable unitary base; and a controls cabinet.

Another embodiment provides a method for feeding and filling containers comprising, at stages B and C, feeding and conveying and orienting and aligning closures; at stages B and C, conveying and feeding and orienting and aligning containers; and once emptied of the containers, container fixtures are indexed onto a return conveyor where they are transported back to a loading and filling end. For yet further embodiments, stage B feeding and conveying and orienting and aligning the closures comprises rotating a disc having at least one aperture having a variable rotation rate and direction; receiving the closure with at least one aperture with a beveled profile configuration, and a diameter proportionally larger than a diameter of the closure; the aperture being located within the disc at a radius and angle determined to achieve optimal feed rates; and an interval between apertures being selected for optimal feed rates. For more embodiments, stage C conveying and feeding and orienting and aligning the containers comprises transporting the containers along one or more vertical conveyors; depositing the containers into one or more rotating circular receptacles; outputting the containers axially oriented in the same direction; and feeding the containers downward through one or more chutes to an escapement and finally depositing the containers with open end up into the fixture. Continued embodiments comprise testing the orientation of the containers to as to whether the end to be filled is oriented up toward the filler. Additional embodiments further comprise at a stage A, placing closures in a closure hopper; at stage A, placing containers in a container hopper; at a stage D, fixture loading and transporting the containers along a container path one; at stage D, transporting the closures along closure chute path one; at a stage E, filling the containers; at a stage F, transporting the containers along a container process conveyor path two; at a stage G, applying and sealing the closures on the containers; indexing to transfer position; at a stage H, labeling the containers; at a stage I, printing the containers; and at a stage J, post-processing and ejecting finished product.

A yet further embodiment provides a system for feeding and filling tubes comprising, in a primary and a final tube orienting and loading mechanism, removing and unscrambling and orienting the tubes from a bulk tube storage device, wherein the bulk tube storage device is integral with the system and within the footprint of the system; in a cap primary and a cap final orienting escapement mechanism, removing and unscrambling and orienting tube caps from a bulk cap storage device, wherein the bulk cap storage device is integral with the system and within footprint of the system; filling a product into the tubes in a tube filling mechanism; applying and tightening the caps to the tubes in a sealing mechanism; labeling the tubes in a labeling device; printing the tubes in a printing device; and ejecting the tubes from the system; wherein, once emptied of the containers, the fixtures are indexed onto a return conveyor where they are transported back to the loading and filling end.

BRIEF DESCRIPTION OF THE DRAWINGS

FIG. 2 is a system operation diagram configured in accordance with an embodiment.

DETAILED DESCRIPTION

Figure 1:
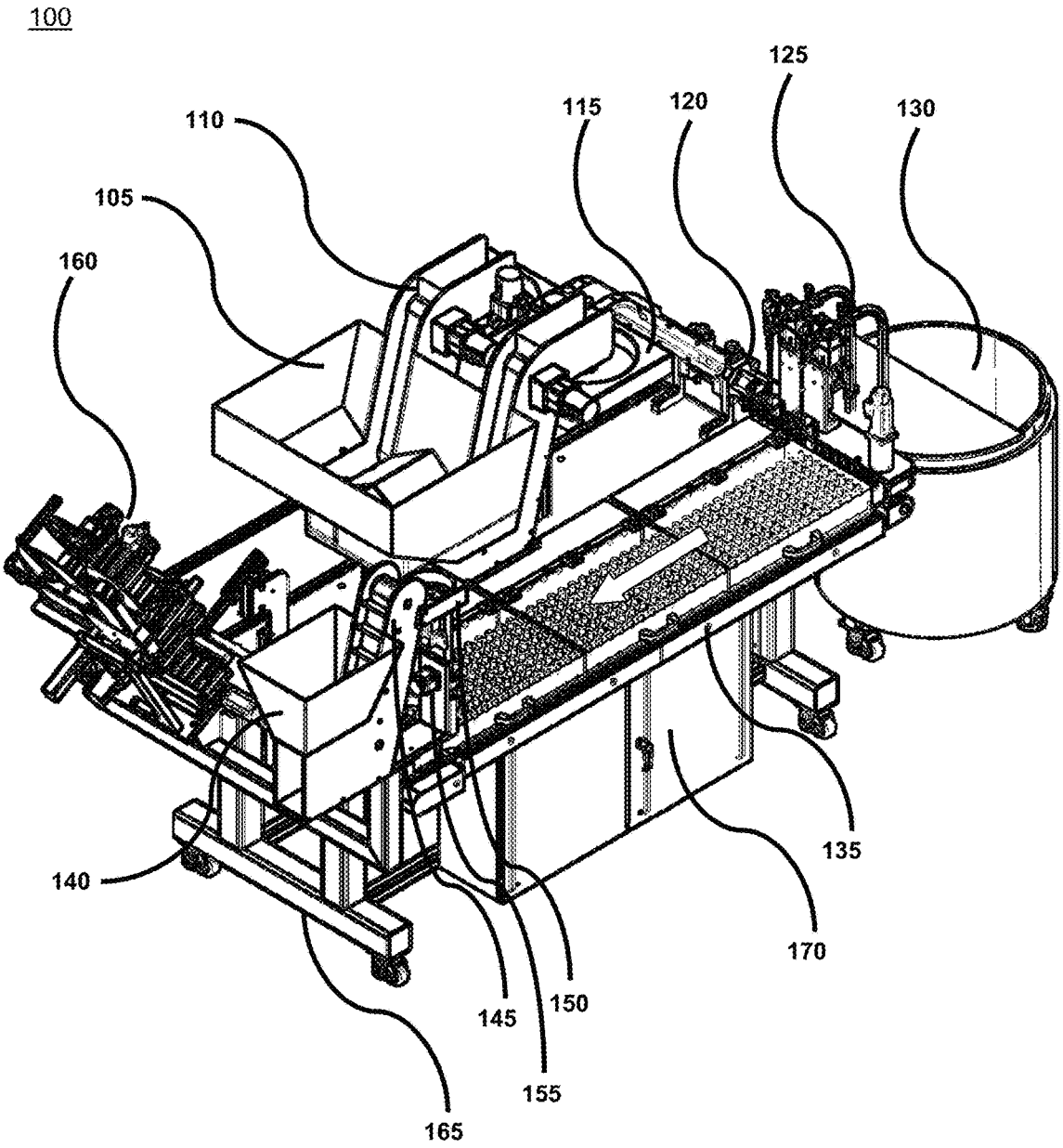
FIG. 1 is a system component perspective view configured in accordance with an embodiment.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes, and not to limit in any way the scope of the inventive subject matter. The invention is susceptible of many embodiments. What follows is illustrative, but not exhaustive, of the scope of the invention.

The invention is an implementation of components designed extraordinarily compactly, and mounted on a single base which has the benefit of being much smaller than the existing technologies. The single base design may or may not be portable.

Embodiments of the invention comprise elements to execute one or more of the following filling activities: 1 Removing and orienting (unscrambling) the product containers from a bulk storage device; 2 Removing and orienting (unscrambling) the container closure (caps) from a bulk storage device; 3 Filling the product into the containers; 4 Applying and tightening the caps to the containers; 5 Labeling the containers; 6 Printing the containers; and 7 Ejecting the containers from the machine.

Summarizing, a compact system, device, and method for filling tubes is disclosed. Containers are circulated in fixtures holding containers vertically. A loading mechanism places the containers into the fixtures sequentially or in parallel. Orientation of the containers is tested to make sure that the end to be filled is oriented up. Containers are fed from a bulk hopper by a conveying means into a primary orienting mechanism and then into the loading mechanism which also serves as the final orienting mechanism. Once a fixture is filled with containers, it is indexed into the filling position where each container is filled with product by a filling mechanism sequentially or in parallel. Product is supplied by a bulk container. After all containers in a fixture are filled, the fixture is moved onto a process conveyor where the product can settle, cool, gel, etc. This process conveyor may have cooling, heating, or other processes affecting the product as it moves along the conveyor. The process conveyor ultimately moves the fixtures to the opposite end of the conveyor where a transfer mechanism indexes the fixture through a cap applicator and cap sealer. Caps are fed from a bulk hopper by a conveying means into a primary orienting mechanism and then through a final orienting/escapement mechanism into an applicator chute. Once the caps are applied, the fixture is indexed into a transfer position where a mechanism removes the containers from the fixture and places them either onto a labeling device or another post-processing device, or simply removes them for downstream processing. Once emptied, the fixtures are indexed onto a return conveyor where they are transported back to the loading and filling end.

FIG. 1 is a system embodiment component perspective view 100. System embodiment components comprise container (tube) bulk hopper 105; container (tube) conveying means 110; primary (tube) orienting mechanism 115; final (tube) orienting and loading mechanism 120; container (tube) filling mechanism 125; bulk product container 130; container (tube) process conveyor 135; cap bulk hopper 140; cap conveying means 145; cap primary orienting mechanism 150; cap final orienting/escapement mechanism 155; labeling device 160; movable base 165; and controls cabinet 170.

FIG. 2 is a system embodiment operation diagram 200. An embodiment method for filling containers comprises, at a Stage A, placing caps in a cap hopper; at Stage A, placing containers/tubes in a tube hopper; at a Stage(s) B/C feeding and conveying/orienting/aligning caps; at Stage(s) B/C conveying/feeding and orienting/aligning containers/tubes; at a Stage D, fixture loading/transporting tubes along tube path one; at Stage D, transporting caps along cap chute path one; at a Stage E, filling containers/tubes; at a Stage F, transporting tubes along tube process conveyor path two; at a Stage G, applying and sealing caps on containers/tubes; index to transfer position; at a Stage H, labeling containers/tubes; at a Stage I, printing containers/tubes; and at a Stage J, post-processing and ejecting finished product. For embodiments, operation comprises inputs of: containers (tubes), caps for the containers, product contents, labels, and ink. For embodiments, stages of filling comprise hoppers holding bulk quantities of containers and caps, conveying means feeders to transport containers and caps from the hoppers, alignment mechanisms to orient the containers and caps, optional additional transport and fixture loading, a product into container filling mechanism, another transport or process conveyor, capping applicator and sealer, container labeling and optional post-processing, and ejecting final product.

Figure 3:
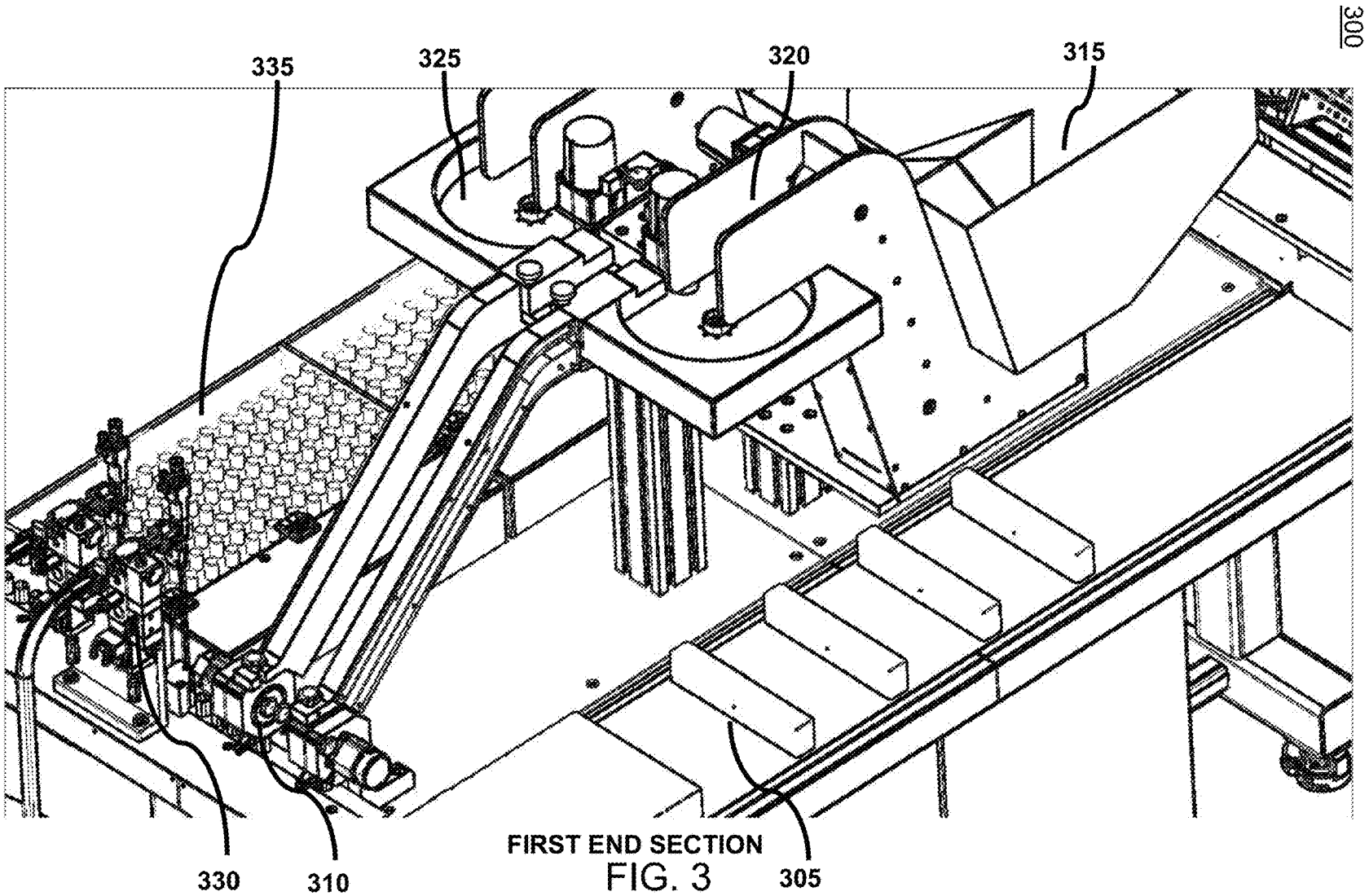
FIG. 3 depicts an end section configured in accordance with an embodiment.

FIG. 3 depicts one end section 300 of embodiments of the invention. The invention is primarily employed for use in the filling of containers (tubes) which have a height greater than their base. In order to firmly support these containers during processing, the containers are circulated through the process in fixtures 305 which hold one or more containers in a vertical orientation. The number of containers that can be held by a fixture depends on the size of the container and the design of the fixture. Container (tube) final orienting and loading mechanism 310 places the containers into the fixtures sequentially or in parallel. The orientation of the containers is tested to make sure that the end to be filled is oriented up. The containers are fed from container (tube) bulk hopper 315, by container conveying means 320, into primary container orienting mechanism 325, and then into loading mechanism 310 referenced above, which also serves as the final container orienting mechanism. Once a fixture is filled with containers, it is indexed into the container filling position where each of the containers is filled with product by container filling mechanism 330, either sequentially or in parallel. The product to be filled is supplied by a bulk product container (FIG. 6, 625), which may be attached to the base of the machine or independent of it. After all of the containers within a fixture are filled, the fixture is moved onto a container process conveyor 335, where the product can settle, cool, gel, etc. This container process conveyor may have cooling, heating, or other processes affecting the product as it moves along the conveyor.

Figure 4:
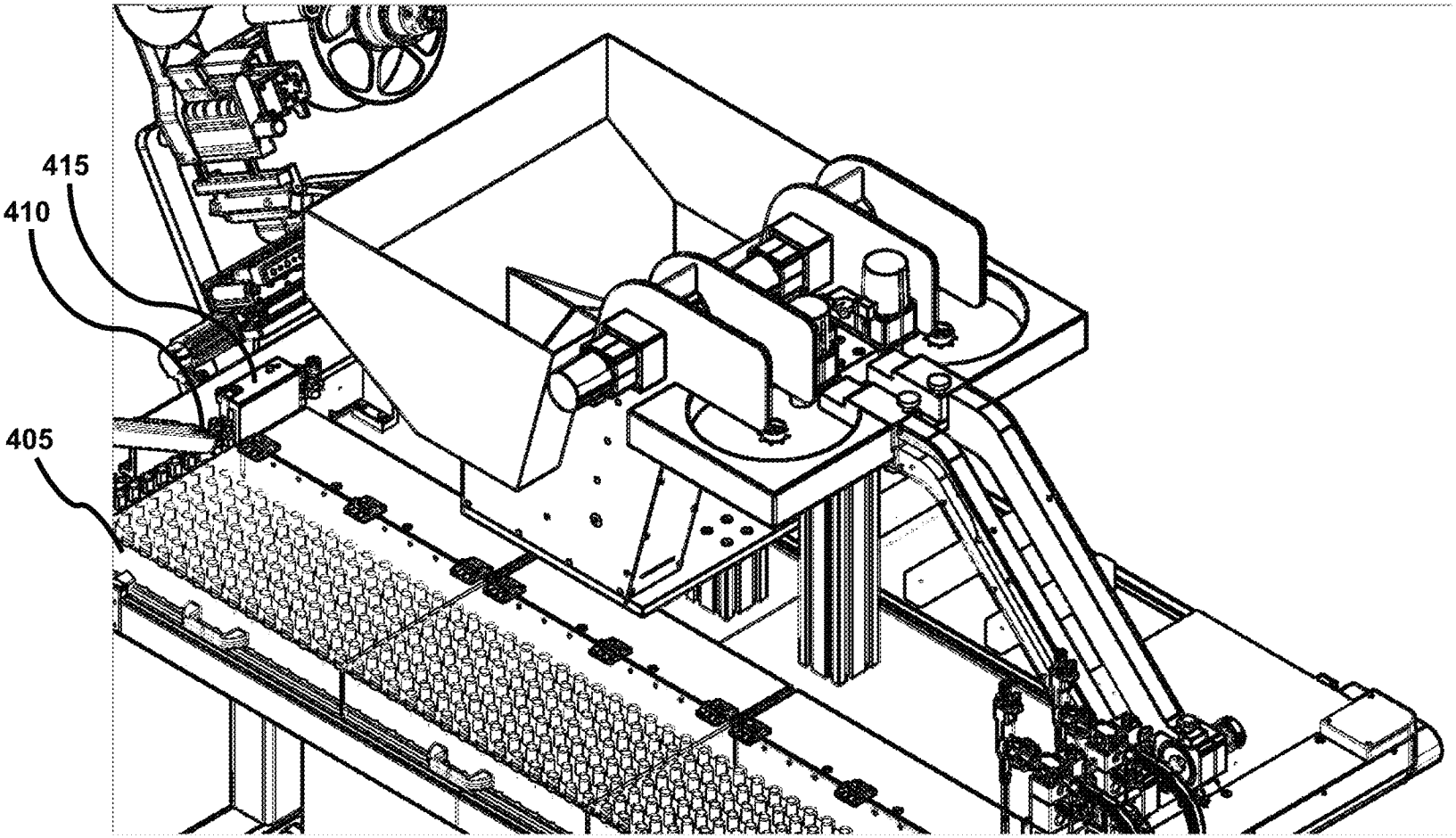
FIG. 4 depicts another end section configured in accordance with an embodiment.

FIG. 4 depicts end section 400 opposite end section of FIG. 3 of the invention. The process conveyor ultimately moves the fixtures to the opposite end of the conveyor 405, where a transfer mechanism indexes the fixture through cap applicator 410, and cap sealer 415.

Figure 5:
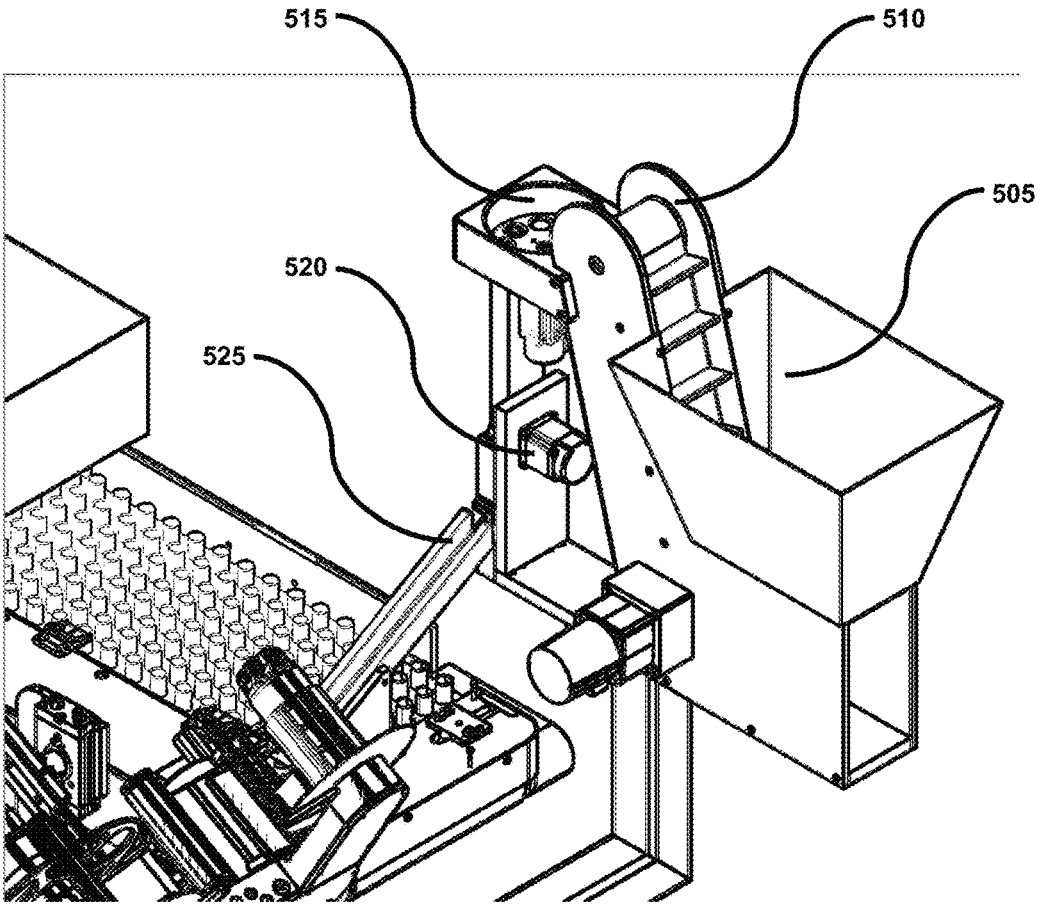
FIG. 5 depicts a cap bulk hopper section of a system configured in accordance with an embodiment.

FIG. 5 depicts cap bulk hopper section 500. The caps are fed from bulk hopper 505, by conveying means 510, into primary orienting mechanism 515, and then through final orienting/escapement mechanism 520, into applicator chute 525.

Figure 6:
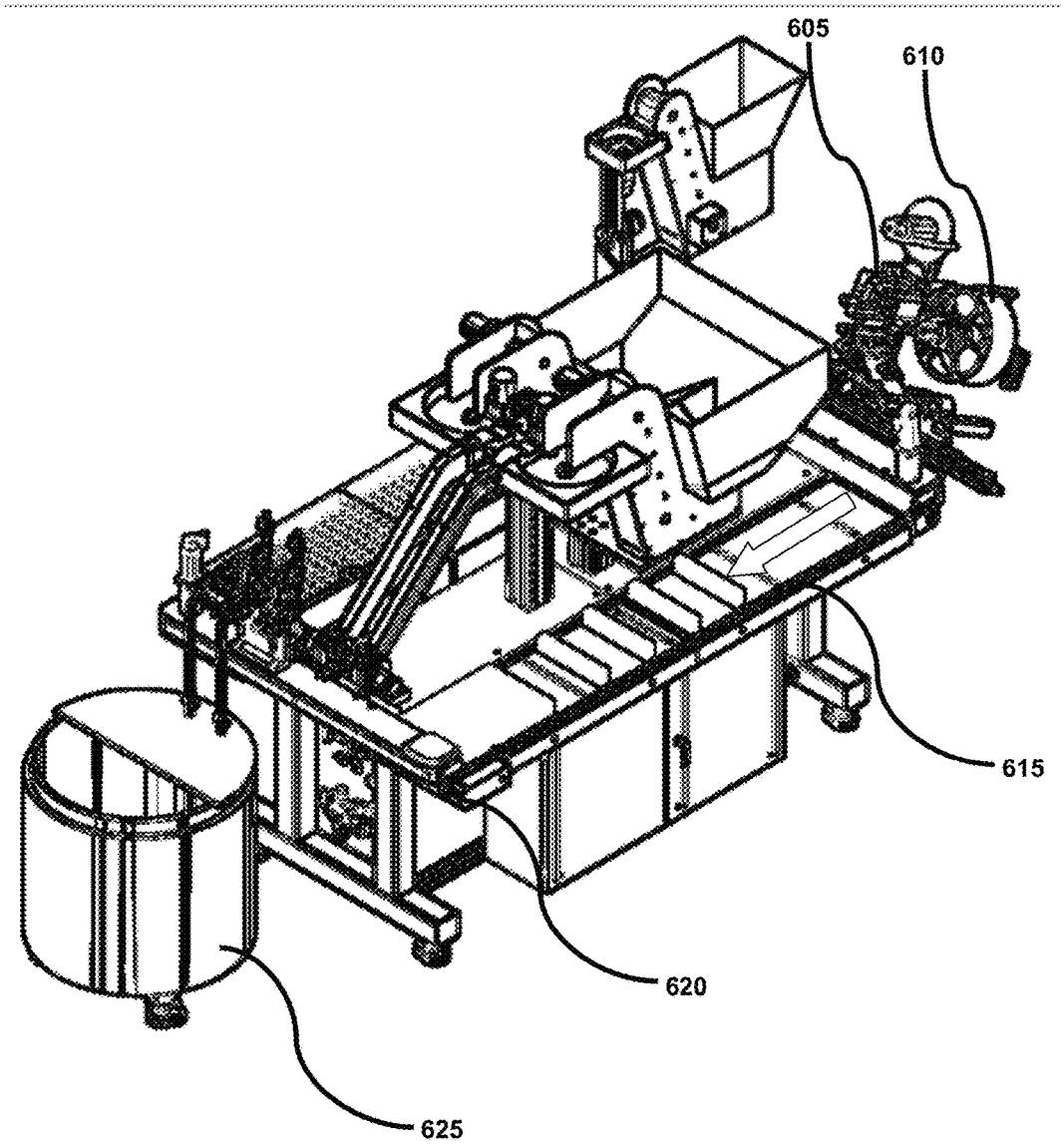
FIG. 6 depicts a system perspective view configured in accordance with an embodiment.

FIG. 6 depicts system perspective view 600. Once the caps are applied (and sealed in embodiments), the fixture is indexed into a transfer position 605, where a mechanism removes the containers from the fixture and places them either onto labeling device 610 or another post-processing device, or simply removes them for downstream processing. Once emptied, the fixtures are indexed onto return conveyor (embodiments may comprise rotating belt(s) engaging at least one fixture, the belt rotating between about a first and a second feet/min. speed, each fixture holding between one and multiple containers, the belt engaging the fixtures by friction in embodiments) 615, where they are transported back to loading and filling end 620.

Benefits of the invention comprise a compact integrated design that allows the machine to be fully assembled and tested at the manufacturer's site, with little or no installation required at the point of use. Other machines are typically built in multiple modules which need to be installed, aligned, and tested at the point of use. The invention's small footprint allows more manufacturing capacity per square foot of floor space. Other machines' large footprint requires more floor space. The invention's proprietary container and cap feeders do not use vibration, and consume no space outside the machine. Conventional machine vibratory feeders need to be isolated from the machine and mounted on separate, large, pedestals. Conventional centrifugal feeders consume large amounts of floor space.

Figure 7:
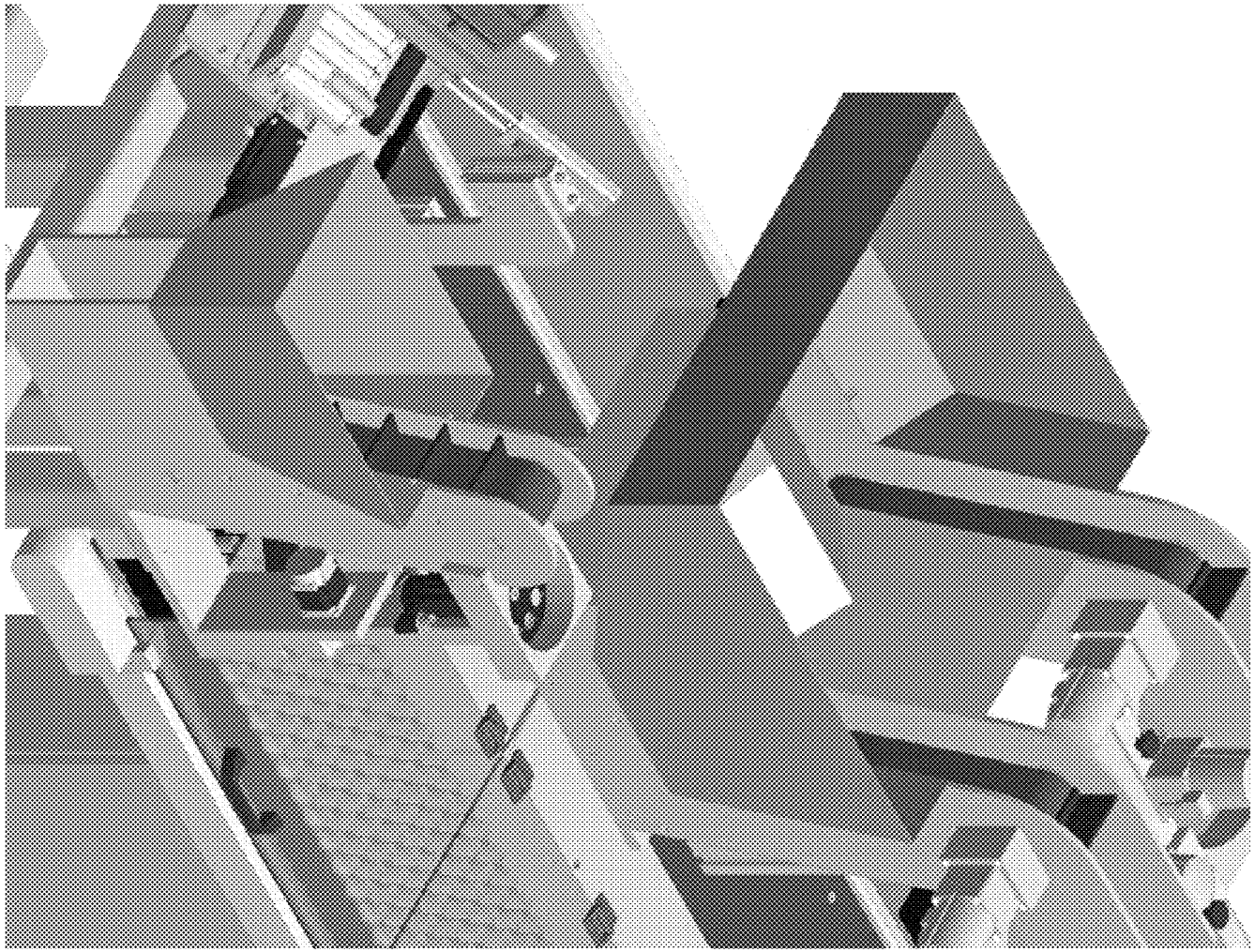
FIG. 7 is a depiction of input elements configured in accordance with an embodiment.

FIG. 7 is a to-scale depiction of input elements 700.

Figure 8:
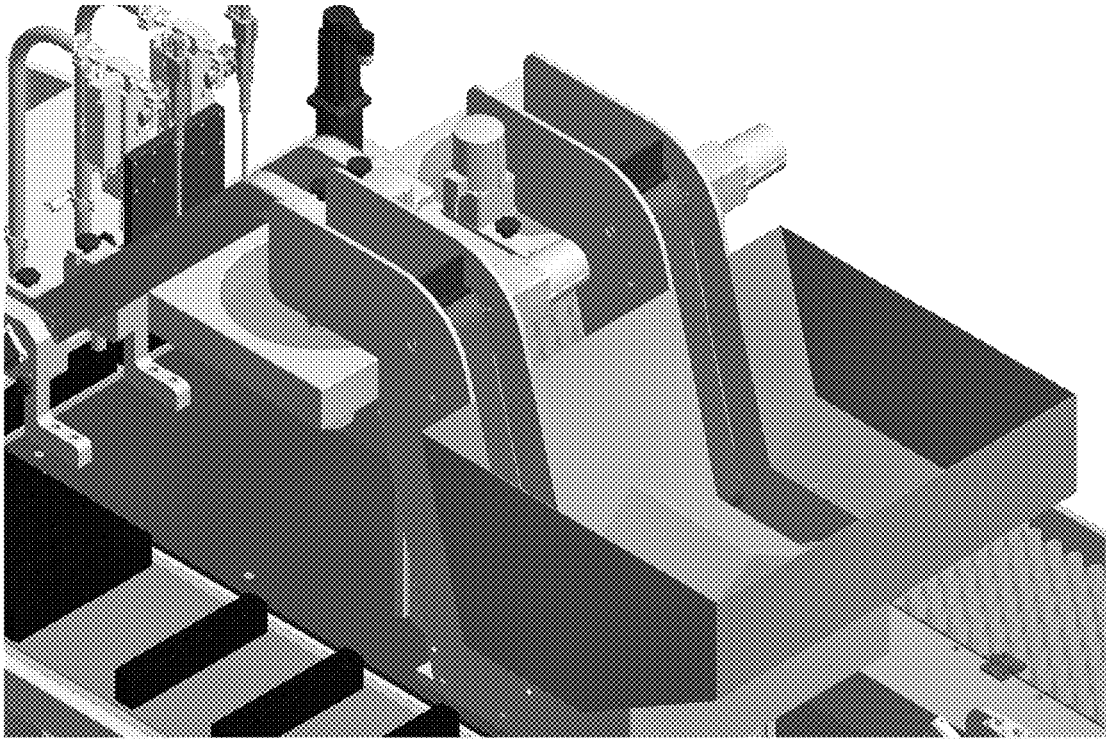
FIG. 8 illustrates container (tube) bulk hopper input of system Stage A configured in accordance with an embodiment.

FIG. 8 is a scale illustration of a container bulk hopper input of system embodiments of Stage A 800.

Figure 9:
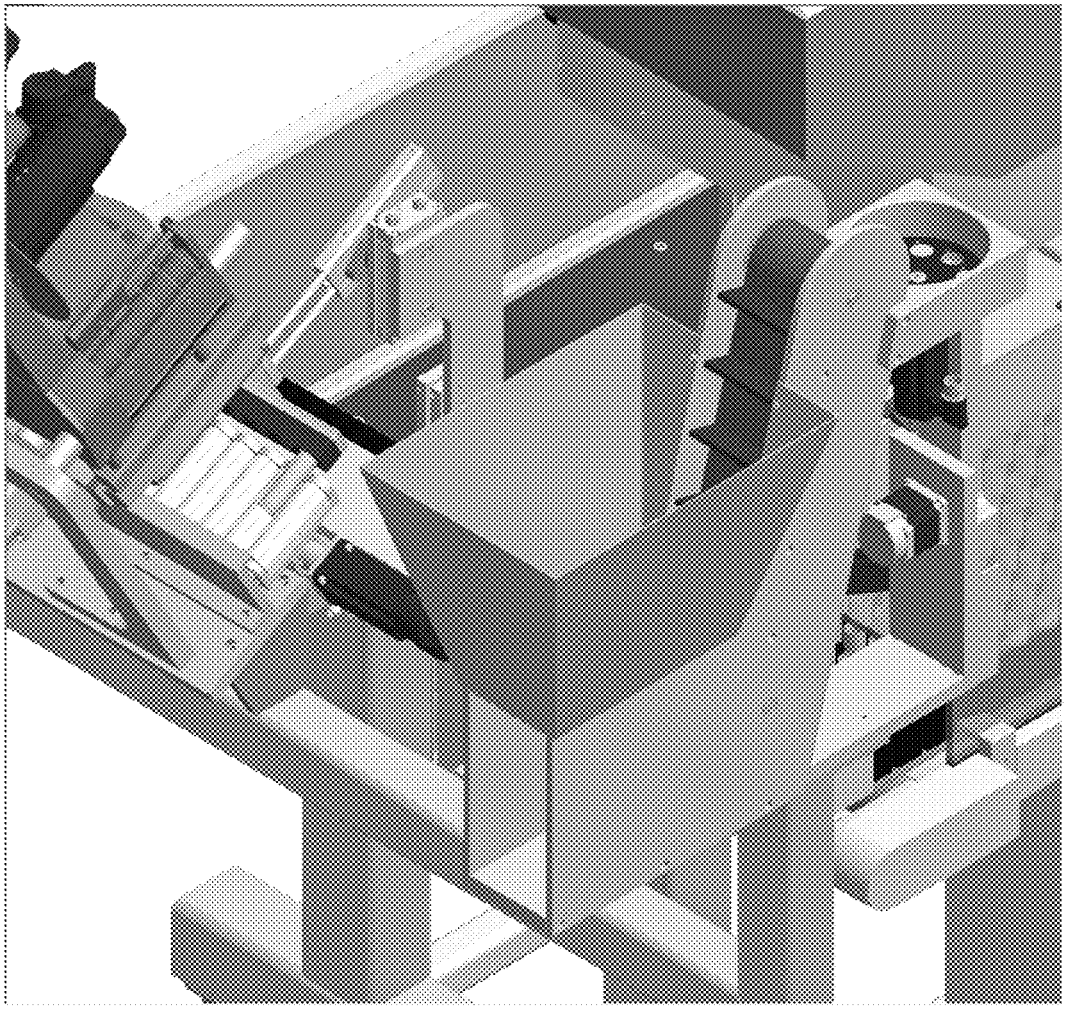
FIG. 9 illustrates cap bulk hopper input of system Stage A configured in accordance with an embodiment.

FIG. 9 is a scale illustration of a cap bulk hopper input of system embodiments of Stage A 900.

Figure 10:
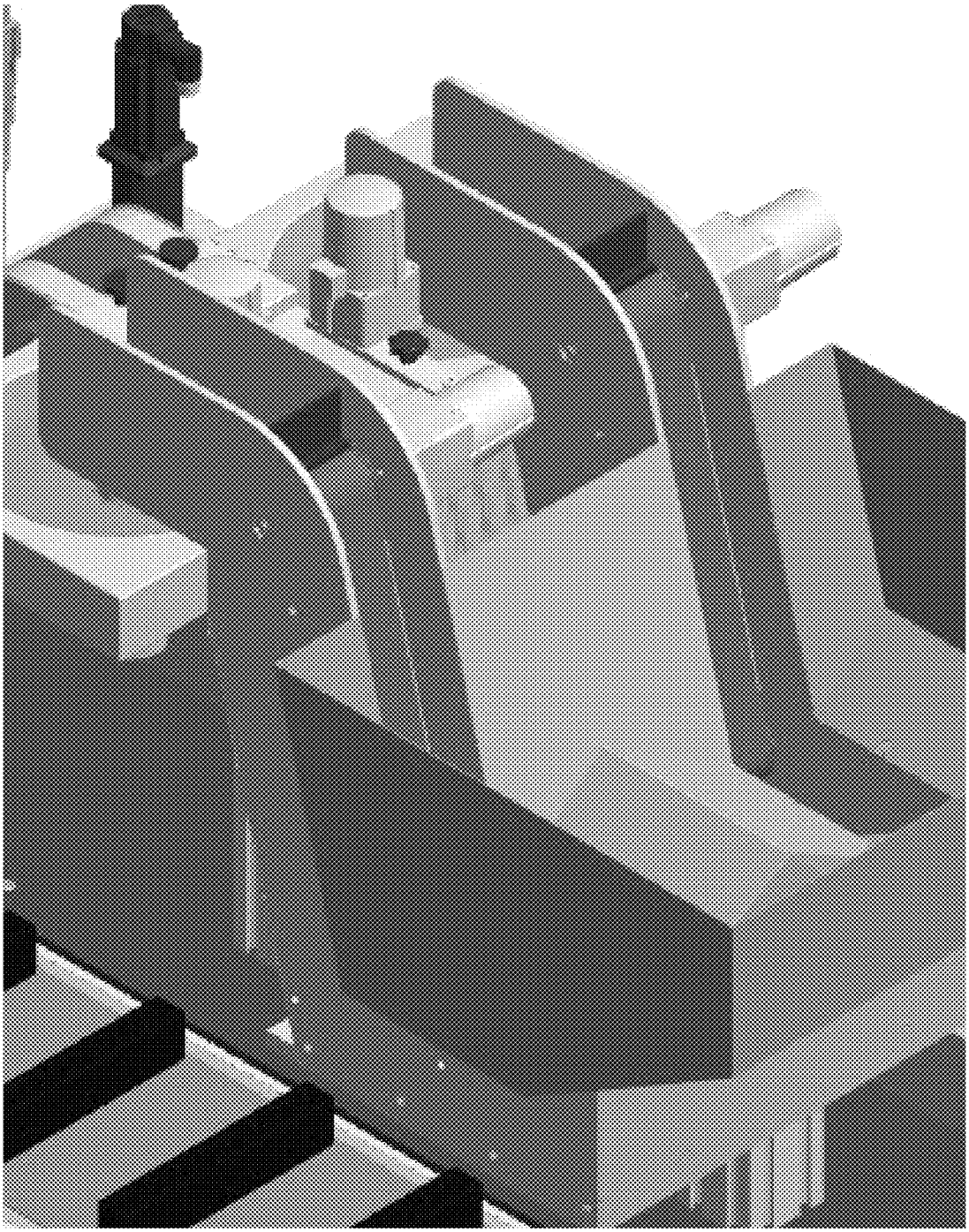
FIG. 10 illustrates container (tube) conveying means of system Stage B configured in accordance with an embodiment.

FIG. 10 is a scale illustration of a container conveying means of system embodiments of Stage B 1000.

Figure 11:
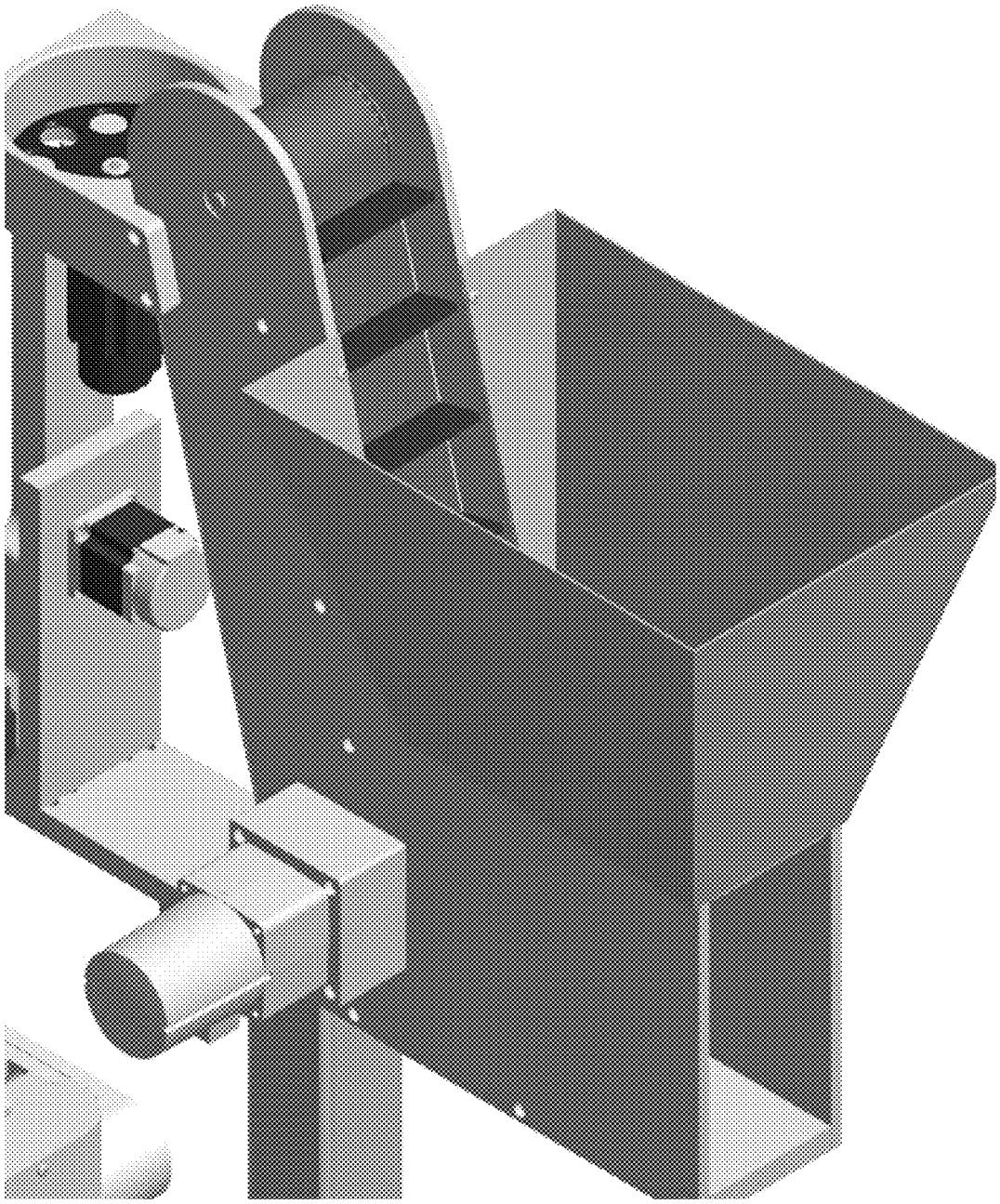
FIG. 11 illustrates cap conveying means of system Stage B configured in accordance with an embodiment.

FIG. 11 is a scale illustration of a cap conveying means of system embodiments of Stage B 1100.

Figure 12:
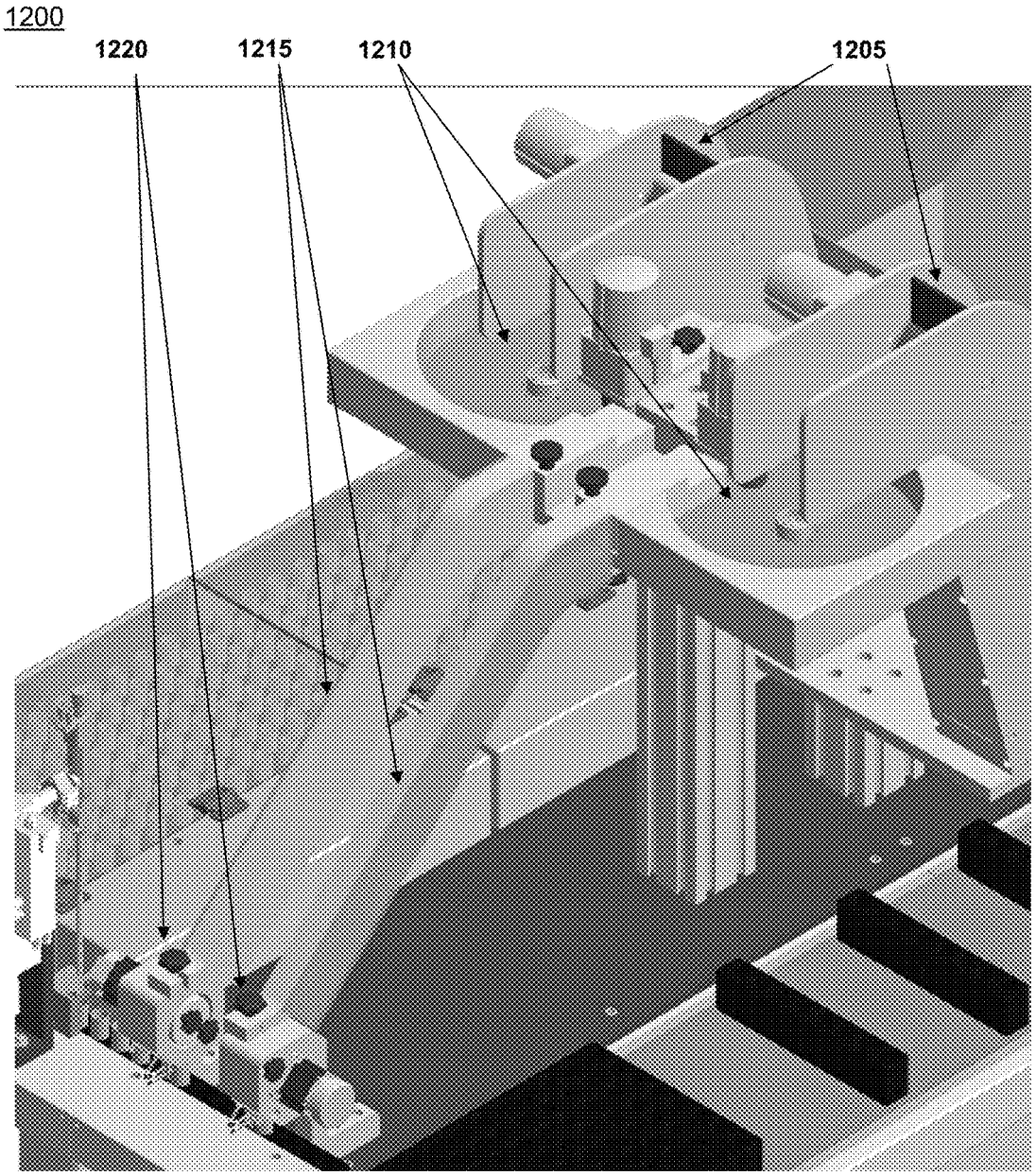
FIG. 12 illustrates container primary and final orienting mechanisms of system Stage C configured in accordance with an embodiment.

FIG. 12 is a scale illustration of a container primary and final orienting mechanisms of system embodiments of Stage C 1200. In embodiments, Stage C comprises transporting containers along a pair of vertical conveyors 1205; depositing the containers axially oriented in random directions 1210; feeding the containers downward 1215 to an escapement and final orientation device 1220; and depositing the containers with the open end up into the fixture.

Figure 13:
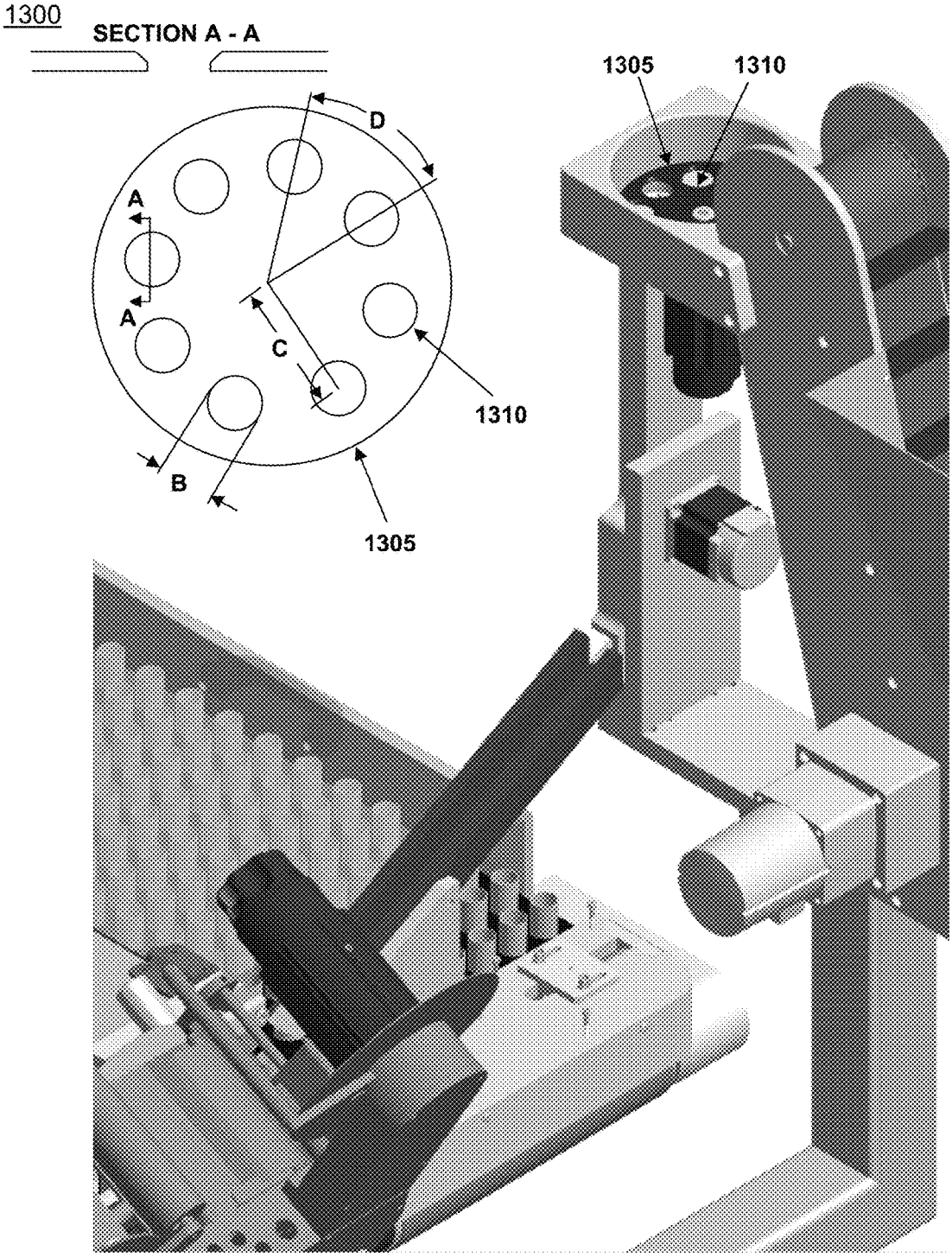
FIG. 13 illustrates cap primary and final orienting mechanisms of system Stage C configured in accordance with an embodiment.

FIG. 13 is a scale illustration of a cap primary and final orienting mechanisms of system embodiments of Stage C 1300. Components comprise a rotating disc 1305 with at least one aperture 1310 having a variable rotation rate and direction; at least one aperture with a beveled profile configuration Section A-A, and diameter B proportionally larger than the cap diameter; located within the disc at a radius C determined to provide optimal feed rates at angle(s) D also determined to provide optimal feed rates; interval between apertures being selected for optimal feed rates. For embodiments, apertures are all evenly spaced. These parameters are important to the operation and not readily alterable. An example of a well performing embodiment has a rotation rate between 10 and 30 RPM, with a change in direction whenever an obstruction is sensed. For embodiments, the bowl diameter is 5" to 7" with an aperture radius of 2.1" to 3" and an aperture size 10% larger than the cap. Using as many holes as will fit evenly is preferred. Optimal feed rates are the greatest component throughput rates that permit the desired alignment.

Figure 14:
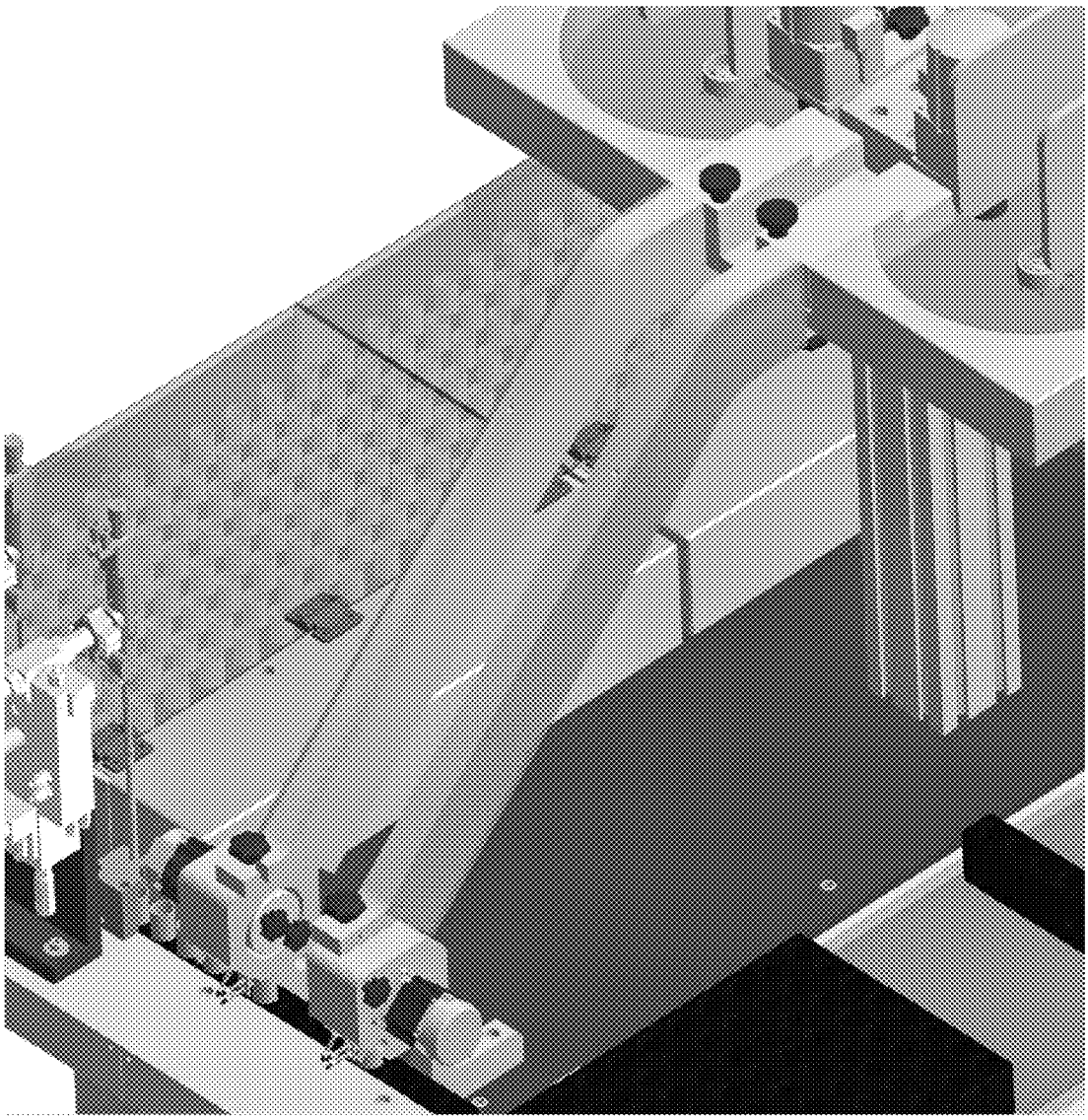
FIG. 14 illustrates tube fixture loading transport path one of system Stage D configured in accordance with an embodiment.

FIG. 14 is a scale illustration of a tube fixture loading transport path one of system embodiments of Stage D 1400.

Figure 15:
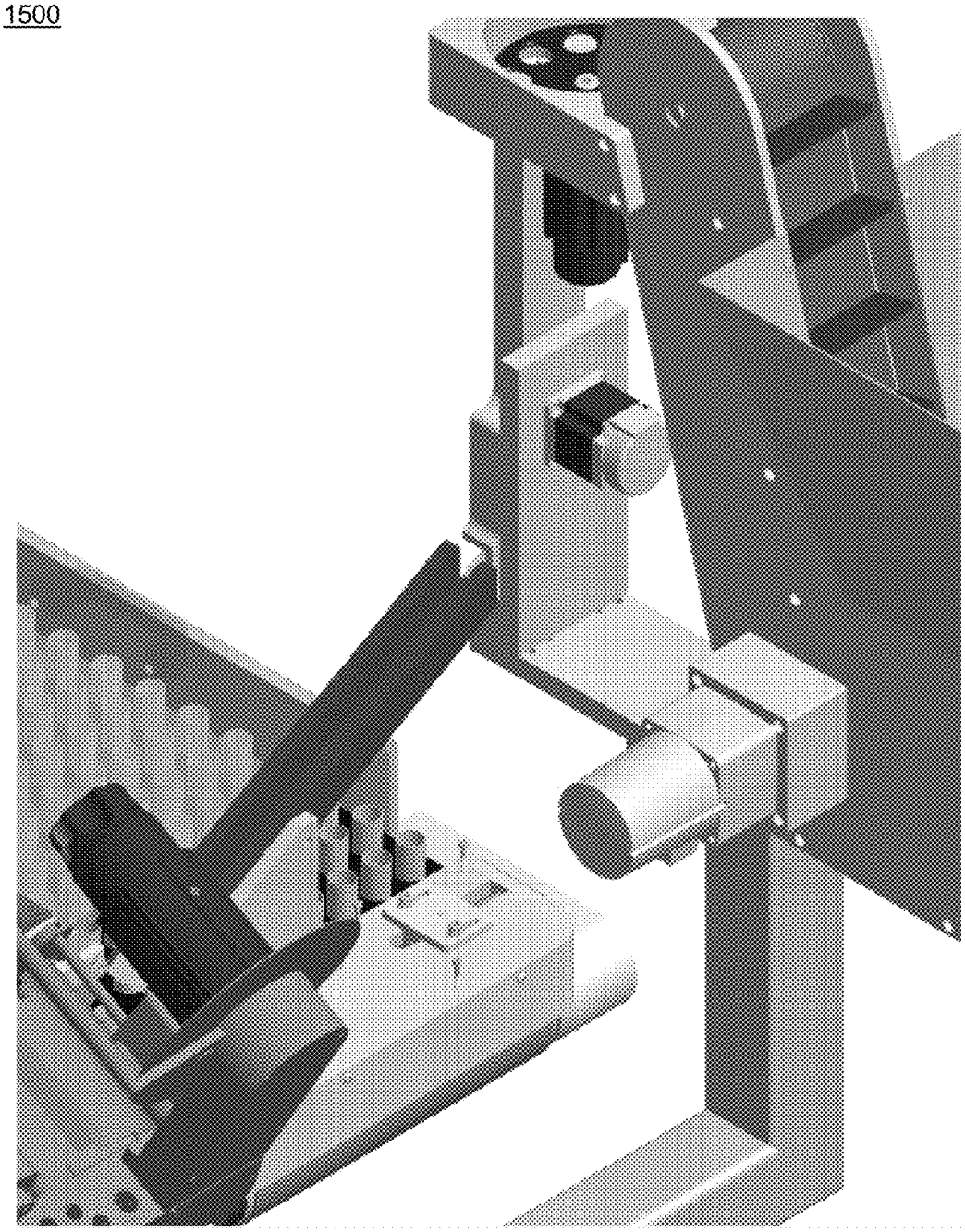
FIG. 15 illustrates cap applicator chute transport path one of system Stage D configured in accordance with an embodiment.

FIG. 15 is a scale illustration of a cap applicator chute transport path one of system embodiments of Stage D 1500.

Figure 16:
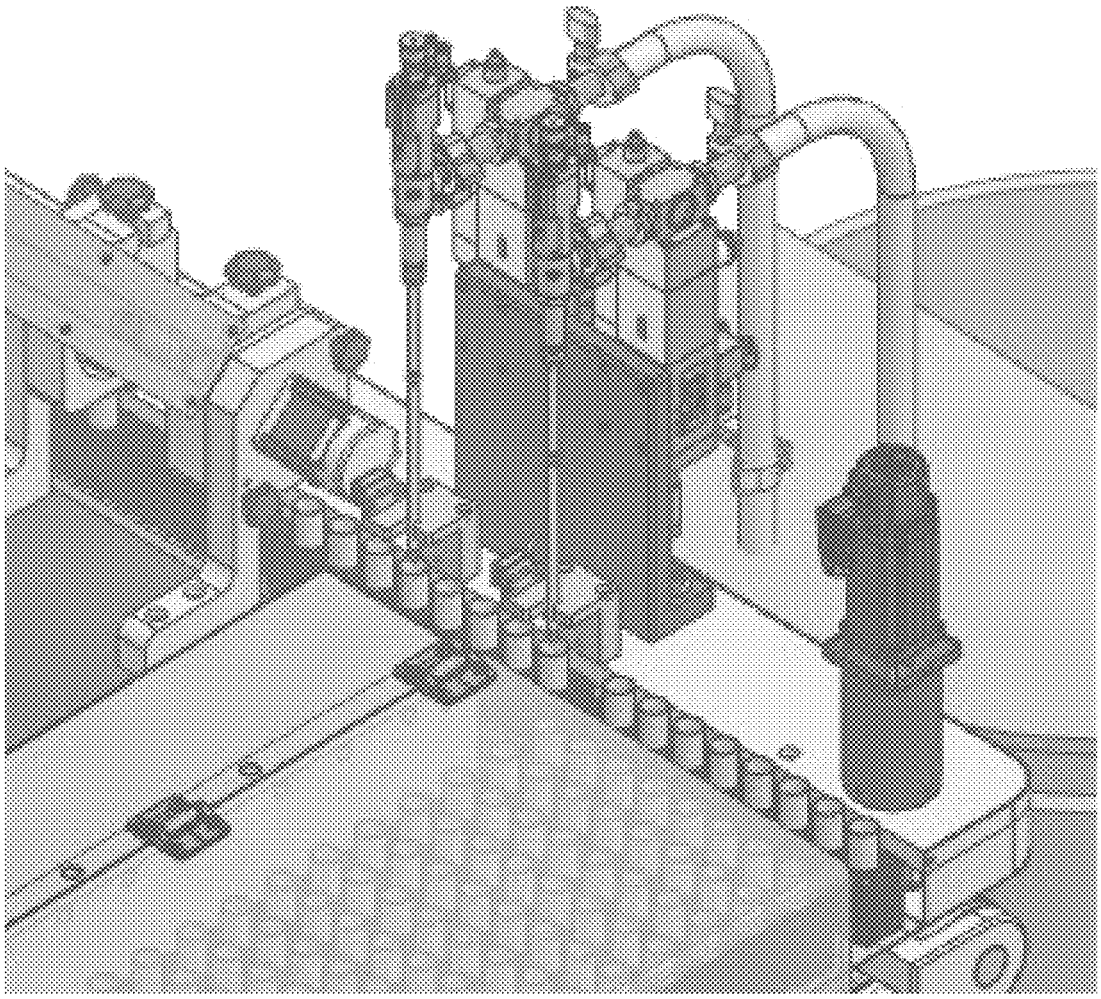
FIG. 16 illustrates tube filling station of system Stage E configured in accordance with an embodiment.

FIG. 16 is a scale illustration of a tube filling station of system embodiments of Stage E 1600.

Figure 17:
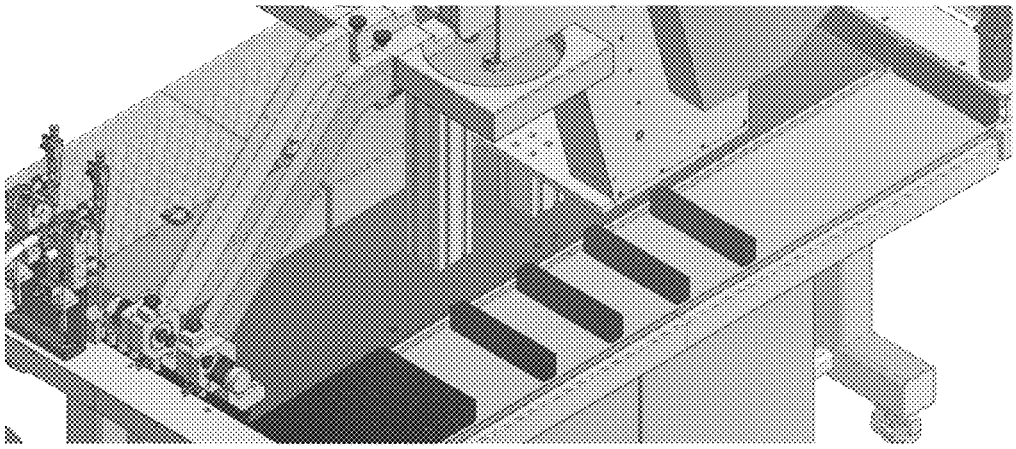
FIG. 17 illustrates tube process conveyor transport path of system Stage F configured in accordance with an embodiment.

FIG. 17 is a scale illustration of a tube process conveyor transport path two of system embodiments of Stage F 1700.

Figure 18:
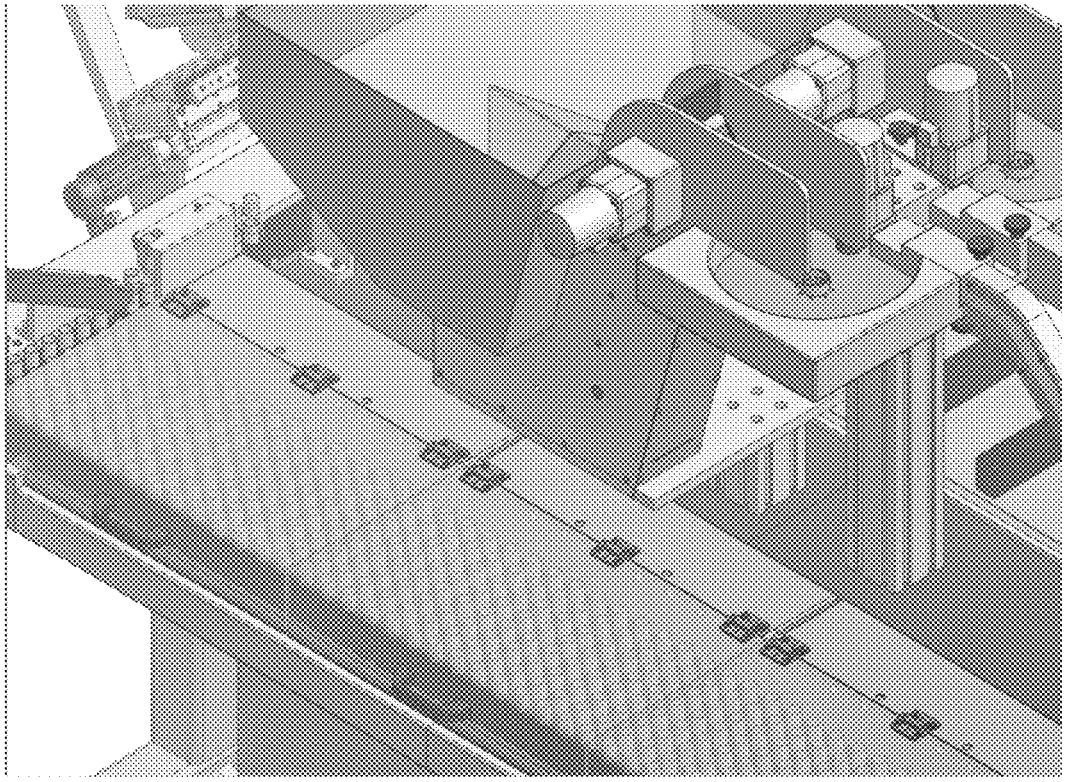
FIG. 18 illustrates capping station of system Stage G configured in accordance with an embodiment.

FIG. 18 is a scale illustration of a capping station of system embodiments of Stage G 1800.

Figure 19:
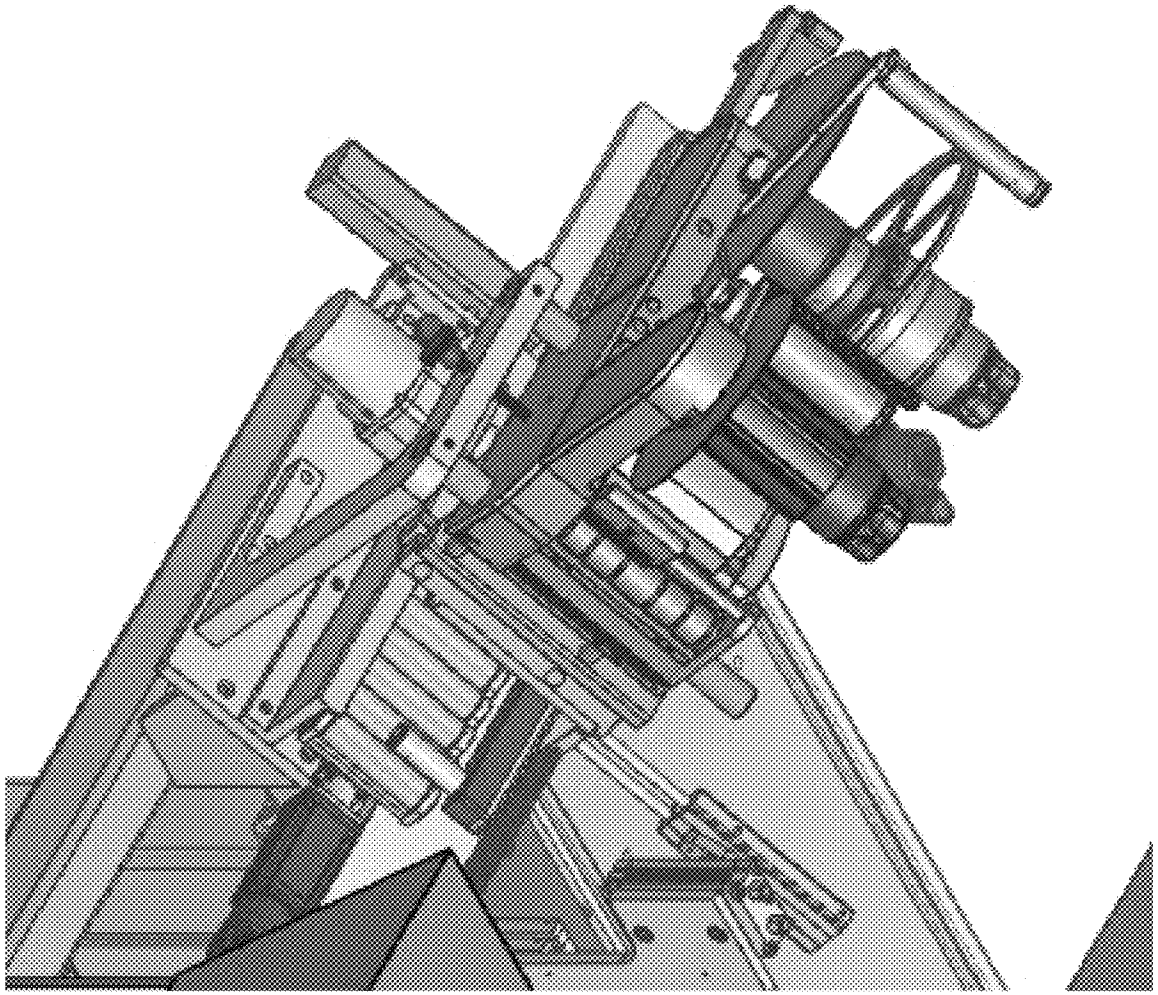
FIG. 19 illustrates labeling station of system Stage H configured in accordance with an embodiment.

FIG. 19 is a scale illustration of a labeling station of system embodiments of Stage H 1900.

Figure 20:
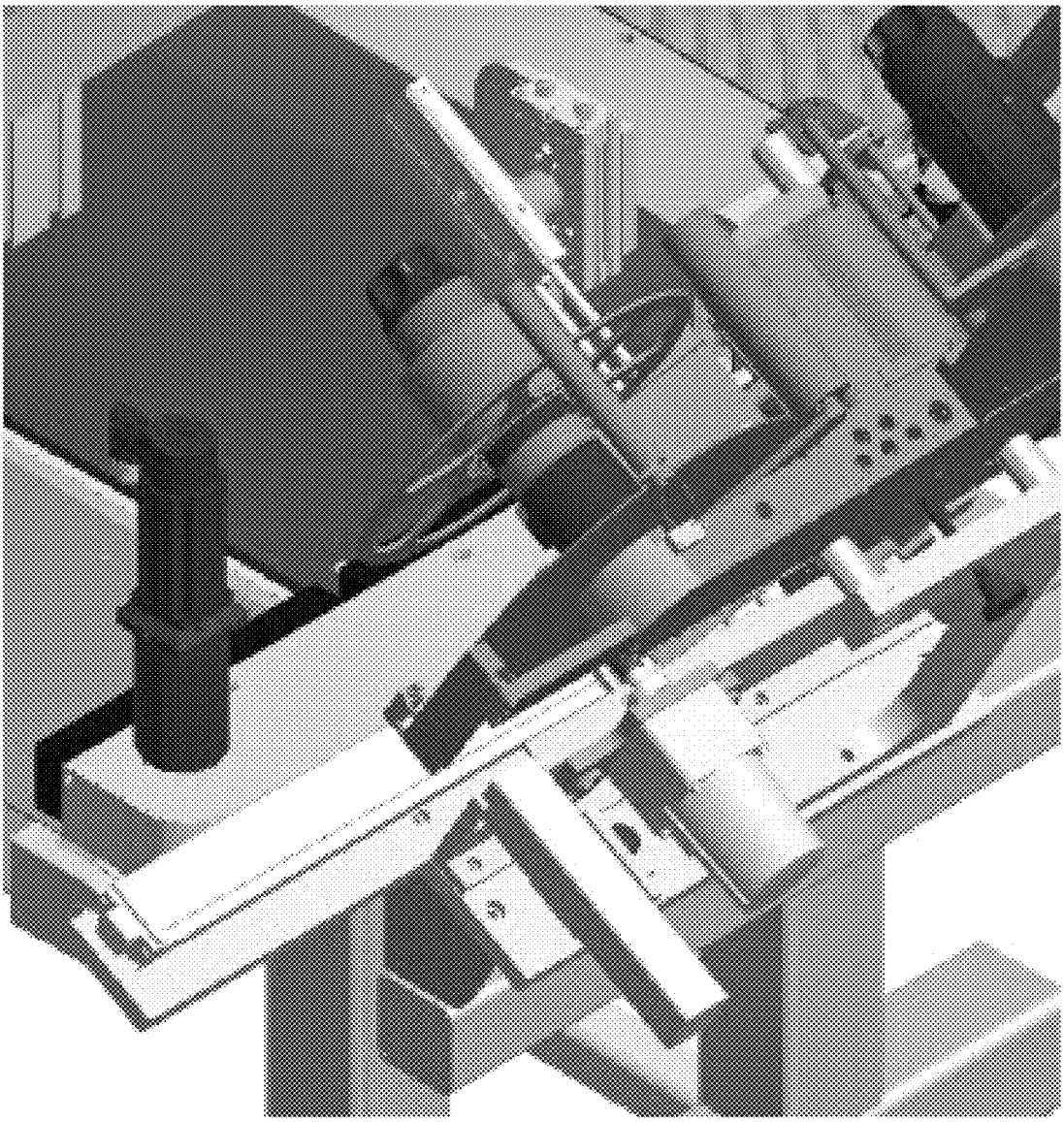
FIG. 20 illustrates printing station of system Stage I configured in accordance with an embodiment.

FIG. 20 is a scale illustration of a printing station of system embodiments of Stage I 2000.

Figure 21:
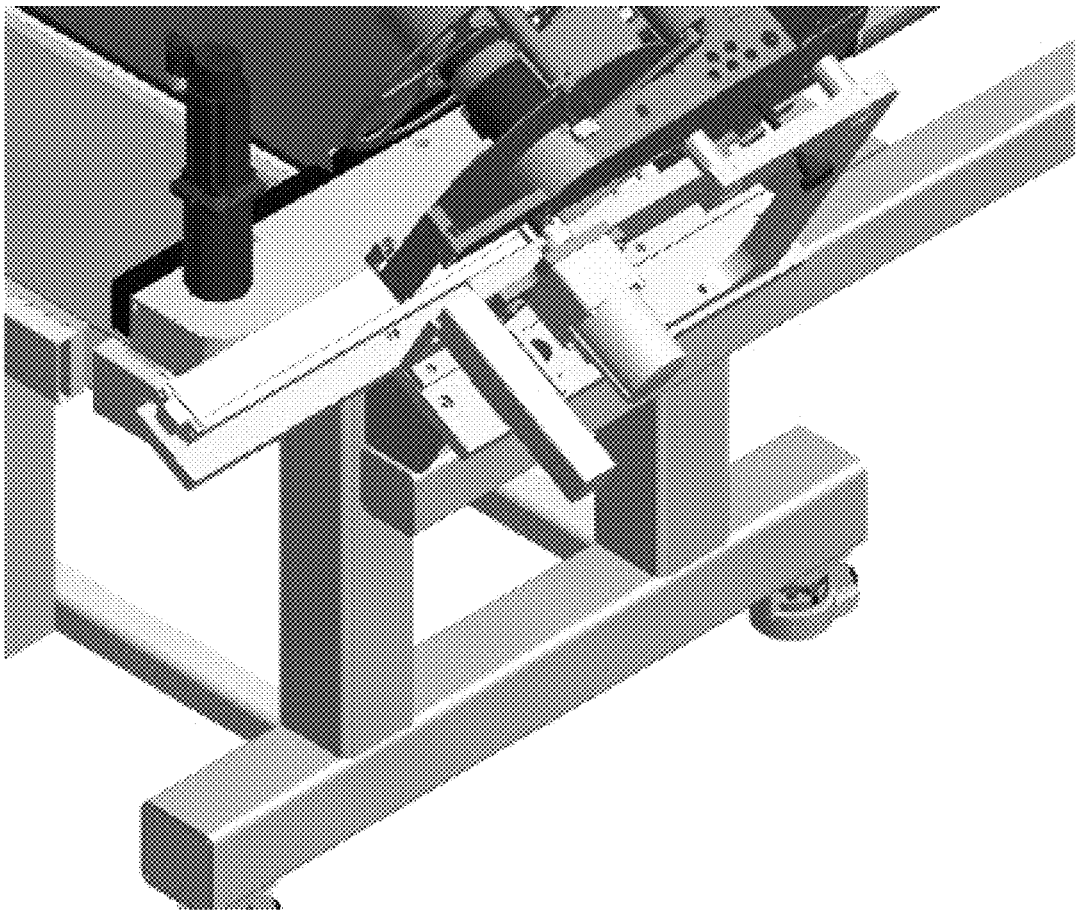
FIG. 21 illustrates product post-processing and ejecting of system stage J configured in accordance with an embodiment.

FIG. 21 is a scale illustration of a product post-processing and ejecting of system embodiments of Stage J 2100.

Figure 22:
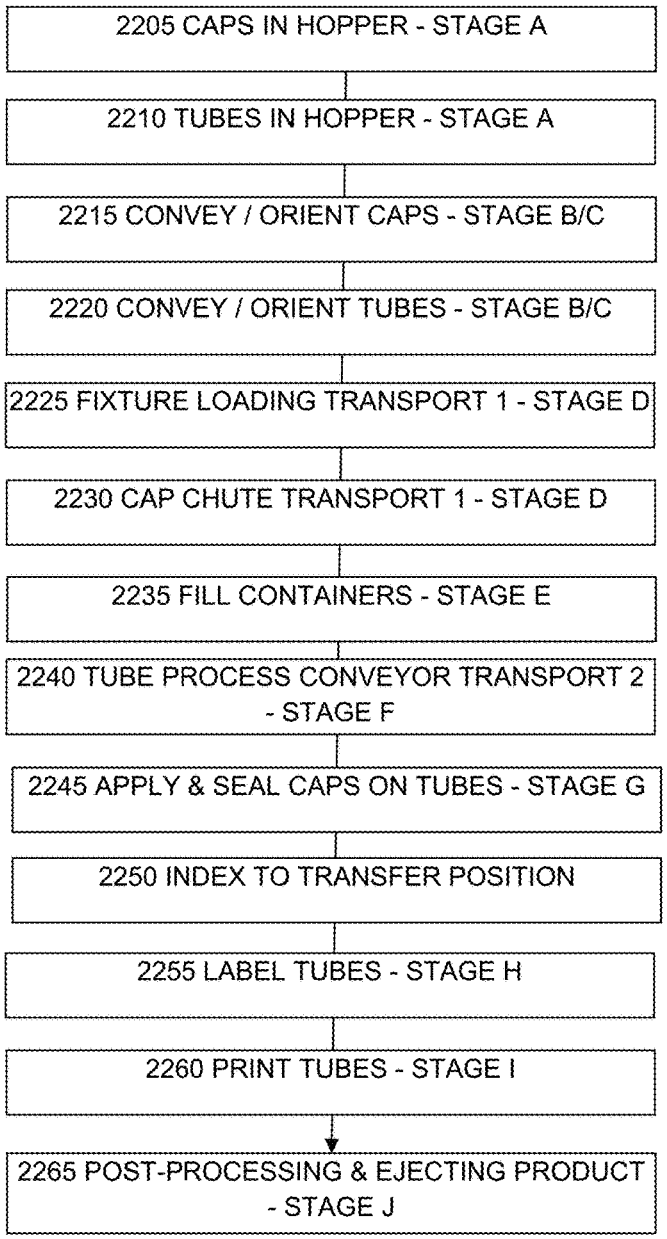
FIG. 22 is a flow chart of a method for compact feeding and filling configured in accordance with an embodiment.

FIG. 22 is a flow chart of a method for compact feeding and filling 2200. Steps comprise Stage A, placing caps in cap hopper 2205; Stage A, placing containers/tubes in tube hopper 2210; Stage(s) B/C feeding and conveying/orienting/aligning caps 2215; Stage(s) B/C conveying/feeding and orienting/aligning containers/tubes 2220; Stage D, fixture loading/transporting tubes along tube path one 2225; Stage D, transporting caps along cap chute path one 2230; Stage E, filling containers/tubes 2235; Stage F, transporting tubes along tube process conveyor path two 2240; Stage G, applying and sealing caps on containers/tubes 2245; index to transfer position 2250; Stage H, labeling containers/tubes 2255; Stage I, printing containers/tubes 2260; Stage J, post-processing and ejecting finished product 2265; once emptied, the fixtures are indexed onto a return conveyor where they are transported back to the loading and filling end.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure. Other and various embodiments will be readily apparent to those skilled in the art, from this description, figures, and the claims that follow. It is intended that the scope of the invention be limited not by this detailed description, but rather by the claims appended hereto.

What is claimed is:

1. A device for feeding and filling containers comprising:
- a primary container orienting mechanism;
- a final container orienting and loading mechanism;
- a plurality of container fixtures;
- a closure primary orienting mechanism;
- a closure final orienting escapement mechanism; and
- wherein once emptied of said containers, said container fixtures are indexed onto a return conveyor where they are transported back to a loading and filling end.

2. The device of claim 1, with container feeder components comprising:
- one or more conveyors for transporting said containers;
- one or more rotating circular receptacles into which said containers are deposited, from which said containers are output axially oriented; and
- one or more chutes feeding said containers downward to a final orienting and escapement device depositing said containers into said fixtures with bodies of said containers similarly aligned.

3. The device of claim 1, with closure feeder components comprising:
- a rotating disc with at least one aperture having a variable rotation rate and direction;
- said at least one aperture comprising a beveled profile configuration, and a diameter proportionally larger than a diameter of said closure;
- said aperture being located within said disc at a radius determined to provide optimal feed rates at an angle also determined to provide optimal feed rates.

4. The device of claim 1, wherein said container is a tube.

5. The device of claim 1, wherein said closure is a cap.

6. The device of claim 1, wherein a height of said container is greater than a base of said container.

7. The device of claim 2, wherein said one or more conveyors for transporting said containers comprises a pair of vertical conveyors, and said one or more chutes feeding said containers downward comprises a pair of chutes.

8. The device of claim 3, wherein said one or more rotating circular receptacles comprises a pair of rotating circular receptacles.

9. The device of claim 1, wherein said container final orienting and loading mechanism places said containers into said fixtures sequentially.

10. The device of claim 1 wherein said container final orienting and loading mechanism places said containers into said fixtures in parallel.

11. The device of claim 1 comprising:
- sorting and aligning without vibration.

12. The device of claim 1, wherein said feeders are integral with said system and located within a footprint of said system.

13. The device of claim 1 comprising:
- at least one processing step comprising heating and or cooling.

14. The device of claim 1 further comprising:
- a container bulk hopper;
- a means for conveying at least one container;
- a container filling mechanism;
- a bulk product container;
- a container process conveyor;
- a closure bulk hopper;
- a means for conveying at least one closure;
- a labeling device;
  - a movable unitary base; and
- a controls cabinet.

15. A method for feeding and filling containers comprising:
- providing a device for feeding and filling containers comprising:
  - a primary container orienting mechanism;
  - a final container orienting and loading mechanism;
  - a plurality of container fixtures;
  - a closure primary orienting mechanism;
  - a closure final orienting escapement mechanism; and
- at a Stage B and a Stage C, feeding and conveying and orienting and aligning closures;
- at said Stages B and C, conveying and feeding and orienting and aligning said containers; and
- once emptied of said containers, said container fixtures are indexed onto a return conveyor where they are transported back to a loading and filling end.

16. The method of claim 15 wherein said Stage B feeding and conveying and orienting and aligning said closures comprises:
- rotating a disc having at least one aperture having a variable rotation rate and direction;
- receiving said closure with at least one aperture with a beveled profile configuration, and a diameter proportionally larger than a diameter of said closure;
- said aperture being located within said disc at a radius and angle determined to achieve optimal feed rates;
- an interval between apertures being selected for optimal feed rates.

17. The method of claim 15 wherein said Stage C conveying and feeding and orienting and aligning said containers comprises:
- transporting said containers along one or more vertical conveyors;
- depositing said containers into one or more rotating circular receptacles;

outputting said containers axially oriented in a same direction; and feeding said containers downward through one or more chutes to an escapement and finally depositing said containers with open end up into said fixture.

18. The method of claim 15 comprising testing said orientation of said containers to as to whether end to be filled is oriented up toward a filler.

19. The method of claim 15 further comprising:

at a Stage A, placing closures in a closure hopper;

at said Stage A, placing said containers in a container hopper;

at a Stage D, fixture loading and transporting said containers along a container path one;

at said Stage D, transporting said closures along closure chute path one;

at a Stage E, filling said containers;

at a Stage F, transporting said containers along a container process conveyor path two;

at a Stage G, applying and sealing said closures on said containers;

indexing to transfer position;

at a Stage H, labeling said containers;

at a Stage I, printing said containers; and at a Stage J, post-processing and ejecting finished product.

20. A system for feeding and filling tubes comprising:

providing a device for feeding and filling containers comprising:

a primary container orienting mechanism;

a final container orienting and loading mechanism;

a plurality of container fixtures;

a closure primary orienting mechanism;

a closure final orienting escapement mechanism; and in a primary and a final tube orienting and loading mechanism, removing and unscrambling and orienting said tubes from a bulk tube storage device, wherein said bulk tube storage device is integral with said system and within footprint of said system;

in a cap primary and a final orienting escapement mechanism, removing and unscrambling and orienting tube caps from a bulk cap storage device, wherein said bulk cap storage device is integral with said system and within footprint of said system;

filling a product into said tubes in a tube filling mechanism;

applying and tightening said caps to said tubes in a sealing mechanism;

labeling said tubes in a labeling device;

printing said tubes in a printing device; and ejecting said tubes from said system;

wherein, once emptied of said containers, said fixtures are indexed onto a return conveyor where they are transported back to a loading and filling end.

* * * * *